US006054955A

United States Patent [19]

Schlegel, Jr. et al.

[11] Patent Number: 6,054,955

[45] Date of Patent: Apr. 25, 2000

[54] FOLDED MONOPOLE ANTENNA FOR USE WITH PORTABLE COMMUNICATIONS DEVICES

[75] Inventors: Herbert Schlegel, Jr., Newburyport, Mass.; Timothy J. Blaney, Fremont, Calif.; Charles M. Difronzo, West Lynn, Mass.

[73] Assignee: Apple Computer, Inc., Cupertino, Calif.

[21] Appl. No.: 08/110,807

[22] Filed: Aug. 23, 1993

[51] Int. Cl.[7] ..... H01Q 1/24; H01Q 9/42

[52] U.S. Cl. ..... 343/702; 343/749; 343/826; 343/846

[58] Field of Search ..... 343/702, 749, 343/828, 826, 846; H01Q 9/30, 9/42, 1/24

[56] References Cited

U.S. PATENT DOCUMENTS

| | | | |
|---|---|---|---|
| 2,994,876 | 8/1961 | Josephson | 343/828 |
| 3,039,095 | 6/1962 | Josephson | 343/708 |
| 3,836,976 | 9/1974 | Monser et al. | 343/795 |
| 3,967,276 | 6/1976 | Goubau | 343/828 |
| 3,984,838 | 10/1976 | Voronoff | 343/739 |
| 4,342,037 | 7/1982 | Dalby | 343/846 |
| 4,396,920 | 8/1983 | Grimberg et al. | 346/846 |
| 4,584,709 | 4/1986 | Kneisel et al. | 455/78 |
| 4,641,366 | 2/1987 | Yokoyama et al. | 343/702 |
| 4,658,266 | 4/1987 | Doty, Jr. | 343/848 |
| 4,803,491 | 2/1989 | Hikuma | 343/702 |
| 4,849,765 | 7/1989 | Marko | 343/702 |
| 4,864,320 | 9/1989 | Munson et al. | 343/833 |
| 4,876,552 | 10/1989 | Zakman | 343/846 |
| 5,048,118 | 9/1991 | Brooks et al. | 455/156 |
| 5,138,328 | 8/1992 | Zibrik et al. | 343/702 |
| 5,184,143 | 2/1993 | Marko | 343/749 |

FOREIGN PATENT DOCUMENTS

| | | | |
|---|---|---|---|
| 0543645A1 | 5/1993 | European Pat. Off. . | |
| 571124A1 | 11/1993 | European Pat. Off. . | |
| 56-12102 | 2/1981 | Japan | 343/828 |
| WO85/00480 | 1/1985 | WIPO . | |
| WO91/05374 | 4/1991 | WIPO . | |

OTHER PUBLICATIONS

Patent Abstracts of Japan, vol. 10, No. 104, Apr. 19, 1986, (E397) (2161), 60–242705.

*Primary Examiner*—Michael C. Wimer
*Attorney, Agent, or Firm*—Burns, Doane, Swecker & Mathis, L.L.P.

[57] ABSTRACT

An antenna arrangement of sufficiently small size to be accommodated in the housing of a portable communications device includes a pair of spaced folded monopole antennas. Each antenna includes a first printed circuit board having a conducting surface that forms a ground plane. Mounted on the first circuit board is a second printed circuit board having a right-angled strip of conducting material, which forms a folded monopole radiating element. The folding of the monopole reduces its height, to thereby enable it to fit into small casings and the like. To compensate for the effects of the folded monopole on the electrical match, frequency bandwidth and electromagnetic fields, a shunt inductance is introduced between the monopole and the ground plane. The antennas are mounted within cavities that can be lined or coated with metallic material, to improve the radiation patterns of the antennas and isolate them from the electronic components of the communications system.

20 Claims, 3 Drawing Sheets

FOLDED MONOPOLE ANTENNA FOR USE WITH PORTABLE COMMUNICATIONS DEVICES

FIELD OF THE INVENTION

The present invention is directed to an antenna arrangement that is suited for use in a wireless communication system, such as a local area network. In particular, the invention is directed to such an antenna arrangement whose size and configuration facilitate its incorporation into the structure of a portable communication device.

BACKGROUND OF THE INVENTION

Most antennas that are designed for hand-held and portable communications devices are external, attachable extrusions. For example, many cellular telephones use a form of monopole or dipole antenna that protrudes from the telephone case which houses the rest of the communications electronics.

While an external antenna may be acceptable for devices such as hand-held cellular telephones, it is not as desirable in other applications, such as a wireless communications device that is adapted to be used with a laptop computer or the like. For example, if the computer is located in a confined space, an external antenna which extends therefrom may prove to be cumbersome and provide an unnecessary constraint on the locations at which the computer can be placed. In addition, because of its external nature, the antenna could be easily broken as the computer is moved. Furthermore, since the antenna is accessible by the user, the possibility exists that it could be modified, and thereby alter the communications parameters to values other than those for which the communications device was designed.

Accordingly, it is desirable to provide an antenna arrangement that can be internally housed within the structure of a communications device. By building the antenna into a case that houses the communications electronics, for example, several levels of protection are provided. First, the antenna is not subject to breakage or illegal access, thereby increasing the reliability and integrity of the communications system. In addition, an internally located antenna has reduced proximity to human operators, thereby providing an increased safety margin relative to electromagnetic fields and other forms of radiation associated with antennas.

While internally mounted antennas provide the foregoing advantages, they also have attendant constraints. First and foremost among these is the antenna's size. Typically, a monopole antenna has a height equal to about one-fourth of the wavelength for the carrier frequency over which communications are carried out. Even at a relatively high frequency of 2.4–2.5 GHz, the one-fourth wavelength height of the antenna is approximately 1.2 inches. In a structure such as a laptop computer, or an attachment for such a computer, the internal dimensions of the case may not provide sufficient space for an antenna of this height. Accordingly, when an antenna is to be incorporated into a small structure, some physical modification of the antenna is required, to accommodate the available space. Such a modification typically alters the radiation transmission and reception characteristics of the antenna, however, which may prove to be undesirable.

BRIEF STATEMENT OF THE INVENTION

Accordingly, it is an objective of the present invention to provide an antenna arrangement which has a sufficiently small size that can be accommodated in the housing of a portable communications device, or the like, and yet which provides acceptable radiation characteristics. In accordance with the present invention, this objective is achieved by means of a folded monopole antenna arrangement. To provide spatial diversity, and thereby increase the antenna's receiving characteristics, two folded antennas are spaced at a distance related to the communications frequency. Each antenna includes a first printed circuit board having a conducting surface that forms a ground plane. Mounted on the first circuit board is a second printed circuit board having a right-angled strip of conducting material, which forms a folded monopole radiating element. The folding of the monopole reduces its height, to thereby enable it to fit into small casings and the like. To compensate for the effects of the monopole folded on the radiation pattern, a shunt inductance is introduced between the monopole and the ground plane.

The antennas are mounted within cavities in a casing which houses the communications system. These cavities can be lined or coated with metallic material, to improve the radiation patterns of the antennas and isolate them from the electronic components of the communications system.

Further features of the invention, as well as the advantages offered thereby, are explained in greater detail hereinafter with reference to a preferred embodiment illustrated in the accompanying drawings.

DETAILED DESCRIPTION

To facilitate an understanding of the invention and its underlying principles, it is described hereinafter with reference to its implementation in a wireless local area network radio transceiver for a laptop computer. It will be appreciated, however, that the practical applications of the invention are not limited to this particular embodiment. Rather, the invention can find utility in any application in which it is desired to incorporate an antenna into the interior of a housing having limited space.

Figure 1:
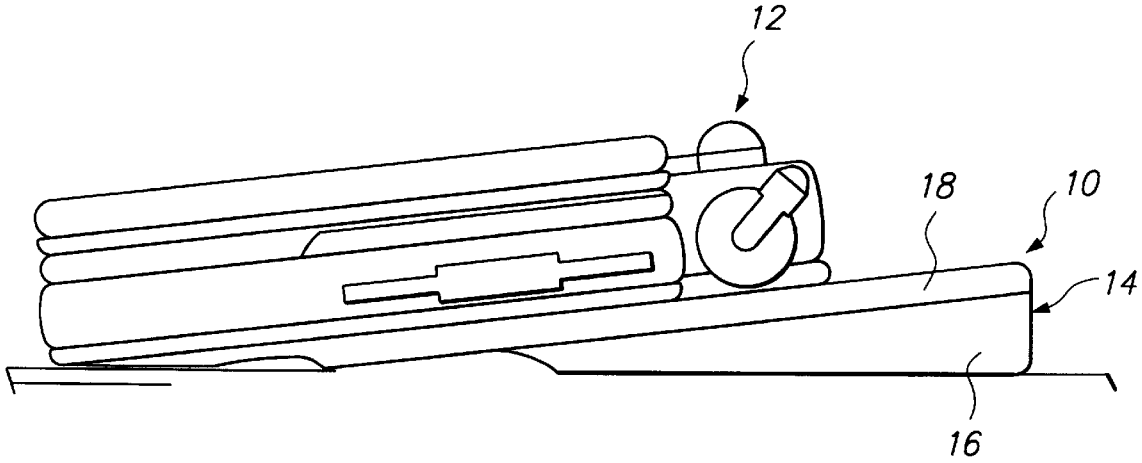
FIG. 1 is a side view of a laptop computer mounted on a wireless local area network radio transceiver.

Referring to FIG. 1, the antenna arrangement of the present invention can be embodied in a wireless local area network radio transceiver 10 that is adapted to be externally attached to a laptop computer 12. The transceiver 10 includes a plastic case 14 that functions as a platform upon which the computer 12 rests. The computer can be secured to the case, for example by means of suitable screws or the like. The case 14 comprises a lower housing 16 which contains the electronics for the transceiver, as well as the antenna elements. An upper housing 18 covers the lower housing and provides the support surface upon which the computer 12 rests.

Figure 3:
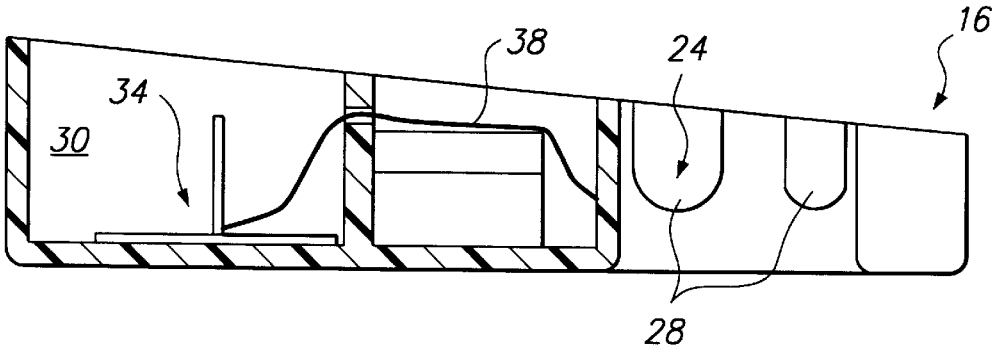
FIG. 3 is a cross-sectional side view of the bottom portion of the casing.
Figure 2:
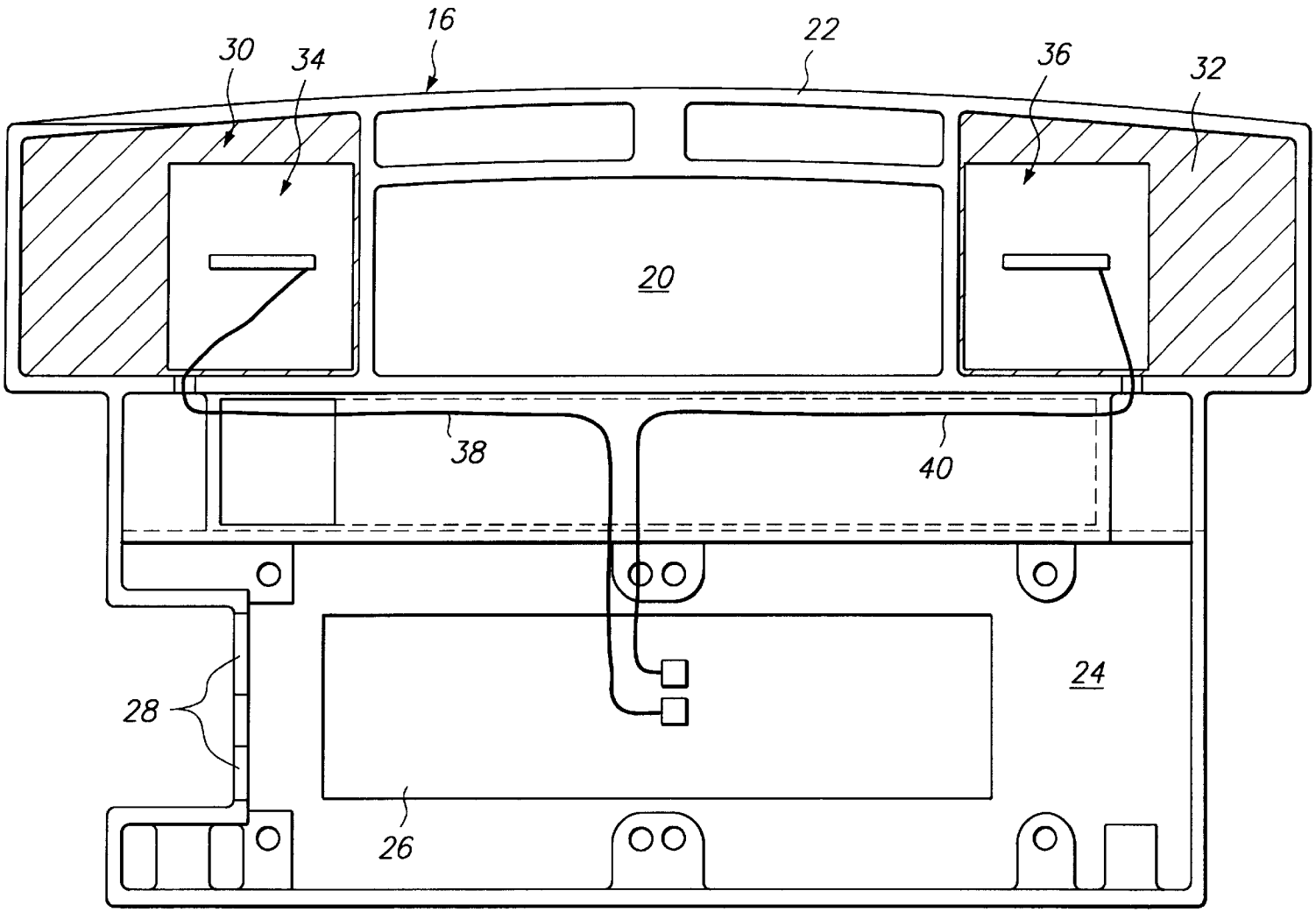
FIG. 2 is a top plan view of the bottom portion of the casing for the transceiver, illustrating the location of the antenna components.

The lower housing 16 of the casing 14 is shown in a top plan view in FIG. 2, and in a cross-sectional side view in FIG. 3. Referring to FIG. 2, an opening 20 near the upper end of the housing 16 (as viewed in FIG. 2) cooperates with a cross-piece 22 to form a handle. As seen in FIG. 1, this portion of the housing extends beyond the laptop computer 12, and thereby forms a convenient carrying handle for both the transceiver 10 and the computer 12 when the computer is attached to the transceiver.

Referring again to FIGS. 2 and 3, a cavity 24 in the housing 16 accommodates the electronic components of the transceiver. These components can be mounted on one or more printed circuit boards 26. A pair of openings 28 on one side wall of the housing form receptacles for suitable electrical connectors (not shown) which enable the electronic components within the cavity 24 to be connected to the computer 12 and other external equipment.

A pair of cavities 30, 32 are respectively formed on opposite sides of the opening 20 which forms the handle. Each of these cavities respectively houses an antenna assembly 34, 36. The antenna assemblies are connected to the electronic components on the printed circuit board 26 by means of associated cables 38 and 40.

Figure 4:
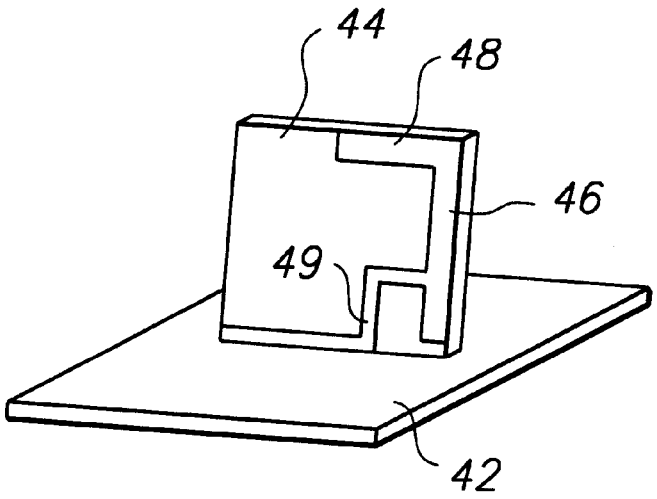
FIG. 4 is a perspective view of one of the antenna structures.
Figure 5:
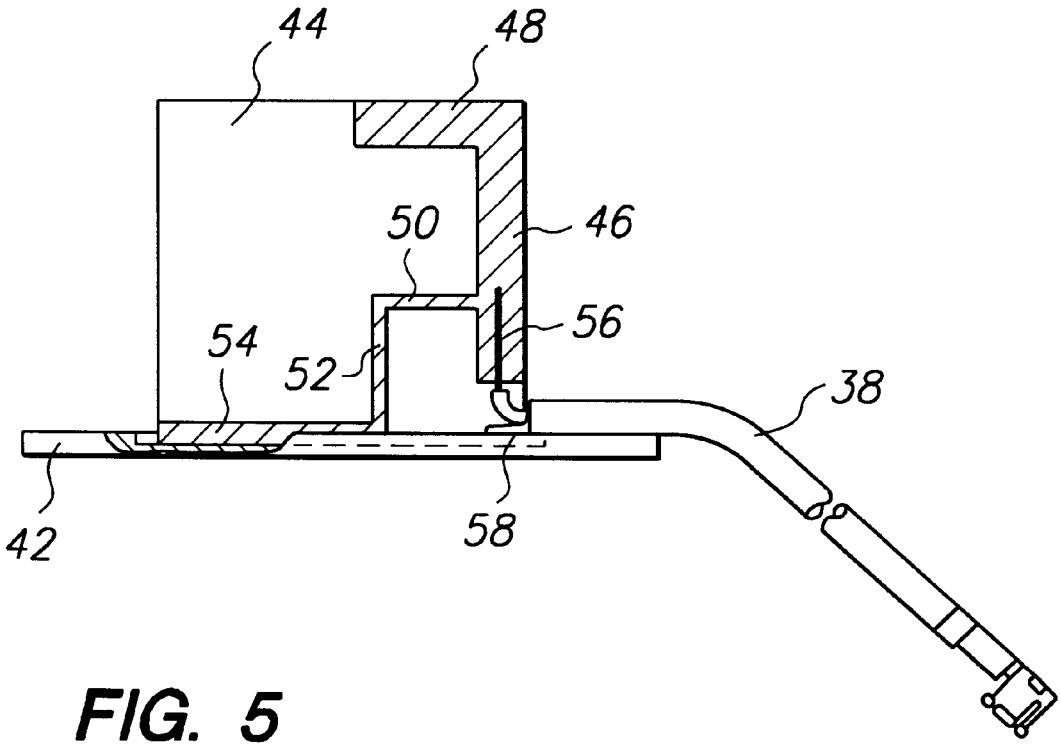
FIG. 5 is a side view of the printed circuit board containing the folded radiating element and the shunt inductance.

A perspective view of one antenna assembly 34 is illustrated in FIG. 4, and a side view thereof is shown in FIG. 5. Referring to these figures, the assembly consists of three main parts. A first printed circuit board 42 has a metallic coating, e.g., copper, on at least the upper side thereof, and functions as a ground plane for the antenna. A square shape for the ground plane is preferred, to provide uniform radiating patterns. A second printed circuit board 44 is mounted in a slot in the first circuit board 42 and oriented perpendicular thereto. The slot is preferably located in the middle of the first circuit board 42, so that the two circuit boards together form a T-shaped structure.

An L-shaped radiating element is formed on one side of the second printed circuit board 44. This element includes a first, generally vertically-oriented leg 46 that is substantially perpendicular to the plane of the first circuit board 42. A second leg 48 is disposed along the top edge of the circuit board 44, and oriented substantially parallel to the plane of the first circuit board 42. The first and second legs 46 and 48 together constitute a folded monopole radiating element.

Generally speaking, a monopole radiating element should have a length that is approximately equal to one-fourth of the wavelength for the carrier frequency over which communications are to take place. For example, if communications take place in the frequency band of 2.4–2.5 GHz, the total length of the monopole should be approximately 1.2 inches. If the monopole were a straight element, each of the cavities 30 and 32 would have to be at least this deep. By utilizing a folded monopole, however, the entire structure need not be this high. For example, the entire height of the structure can be 0.8 inch high, to thereby enable the transceiver casing 14 to maintain a slim profile, and thereby keep the slope of the keyboard on the computer 12 at an ergonomically acceptable level. The extra length of the monopole that does not fit into this height is accommodated by the folded portion 48. The combined lengths of the two legs 46 and 48 is electrically equal to the required radiating length, e.g. 1.2 inches in a 2.4–2.5 GHz system.

In addition to reducing the overall height of the antenna, the folded monopole provides further advantages. For one, it has a horizontal component, as well as a vertical component. As such, the antenna provides polarization diversity, i.e., it can receive both vertically and horizontally polarized radiation. Another advantage of this folded monopole design is that it optimizes horizon coverage in free space.

The folding of the monopole can have an effect upon the electrical match, frequency bandwidth and electromagnetic fields of the antenna. To compensate for any unwanted effects in this regard, a thin-line shunt inductance 49 is connected between the radiating element and the ground plane. This inductance matches the antenna impedance to the output impedance of the port of the radio transceiver and increases the amplitude of the transmitted signal. As shown in FIGS. 4 and 5, this shunt inductance comprises an L-shaped conductor having a horizontal portion 50 connected to the vertical leg 46 of the radiating element, and a vertical portion 52 which is connected to the ground plane. The lengths and positions of these two portions are empirically determined to provide an optimum matching. To facilitate the electrical connection of the vertical portion 52 of the shunt inductance to the ground plane, a connector strip 54 is provided along the bottom edge of the circuit board 44. This connector strip is soldered to the conductive face of the circuit board 42, to provide a good electrical connection between the shunt inductance and the ground plane.

The connector 38 comprises a coaxial cable for connecting the antenna to the transceiver electronics on the circuit board 26. The cable 38 has a center conductor 56 which is attached to the junction of the radiating element and the shunt inductance. The outer, or grounding, conductor 58 of the cable is attached to the ground plane on the first printed circuit board 42. These two attachments are preferably made with solder. A protective non-conductive epoxy (not shown) can be employed to secure and preserve the electrical and mechanical integrity of the two circuit boards and the cable.

Referring again to FIG. 2, the two antennas 34 and 36 are spaced by an amount related to the intended carrier frequency, to optimize reception. More particularly, the maximum amplitude of a traveling wave occurs every half wavelength, and the distance between the maximum and minimum amplitude is one-fourth of a wavelength. In an internal environment of the type in which a wireless local area network is designed to be used, the signals are reflected off numerous surfaces and, as a result of multipath propagation, standing null regions can be created. The possibility always exists that a given antenna could be situated in one of these nulls, and thereby fail to receive a signal. Therefore, to optimize the likelihood that one of the two antennas is situated at the location of a maximum signal amplitude, the physical spacing of the two antennas should be an odd number of one-quarter wavelengths from each other. For example, in a system designed for transmission in the 2.4–2.5 Ghz frequency band, five-fourths of a wavelength is a distance of approximately 6.05 inches, which is readily accommodated in the housing 16. The distance between the two antennas should be as many odd quarter wavelengths as possible, to reduce the interaction and reflection effects between the two antennas. Of course, this spacing is physically limited by the overall size of the housing, and must be less than the maximum distance between the inner housing walls.

Additional measures can be taken to ensure good reception and transmission by the antennas. For example, the length and gauge of the wires in the cables 38 and 40 can be selected to attenuate certain undesirable frequencies, such as a local oscillator (LO) frequency. The particular values for the cable are determined empirically, in dependence upon the communications parameters. In addition, to isolate the antennas from the system electronics and thereby improve overall transmission and reception of signals, one or more walls of the cavities 24, 30 and 32 can be lined or coated with a metallic material, such as copper or aluminum. This coating also functions as a shielding which reduces the radiation energy directed toward the user, thereby increasing the safety of the overall system design.

From the foregoing, it will be appreciated that the present invention provides an antenna arrangement that is suited to be incorporated within the housing of a compact communications device. The folded monopole arrangement has reduced height requirements, thereby enabling the housing to maintain a slim profile. In addition, the spatial diversity provided by dual antennas ensures good reception, regardless of location.

It will be appreciated that the present invention is not limited to the specific embodiments which have been described herein to facilitate an understanding of its underlying principles. The scope of the invention, therefore, is defined by the claims which are appended hereto, rather than the foregoing description, and all equivalents which are consistent with the meaning of the claims are intended to be embraced therein.

What is claimed is:

1. An antenna arrangement comprising at least two antennas spaced from one another by a distance related to a frequency band over which communications are to take place, each of said antennas including:

a metallic base plate which is disposed on a first printed circuit board and forms a ground plane;

a folded radiating element formed on a second printed circuit board and having a first linear portion which extends in a direction generally perpendicular to said base plate and a second linear portion connected to said first portion and extending in a direction generally parallel to said base plate;

a shunt inductance connected between said radiating element and said base plate; and a cable having a first conductor connected to said first portion of said radiating element and a second conductor connected to said base plate.

2. The antenna arrangement of claim 1 wherein each of said second printed circuit boards is mounted on an associated one of said first printed circuit boards such that the first and second printed circuit boards are perpendicular to one another.

3. The antenna arrangement of claim 2 wherein said first printed circuit board includes a slot into which an edge of said second printed circuit board is mounted.

4. The antenna arrangement of claim 2 wherein said second printed circuit board is mounted at approximately the center of said first printed circuit board, to thereby form a T-shaped structure.

5. The antenna arrangement of claim 1 wherein said shunt inductance is formed on said second printed circuit board.

6. The antenna arrangement of claim 1 wherein said shunt inductance includes a first portion that is connected to said first portion of said radiating element and oriented substantially perpendicular thereto, and a second portion oriented substantially parallel to said first portion of said radiating element and connected to said base plate.

7. The antenna arrangement of claim 6, wherein said second portion of said shunt inductance includes an elongated connector strip oriented parallel to said base plate to facilitate electrical connection of said second portion thereto.

8. The antenna arrangement of claim 1 wherein said cable is a coaxial cable having an inner conductor connected to said first portion of said radiating element and an outer conductor connected to said base plate.

9. The antenna arrangement of claim 1 wherein said antennas are spaced at a distance equal to an odd number times one-fourth of the wavelength of a signal at a frequency over which communications are to take place.

10. A portable wireless communications system, comprising:

a housing having a plurality of cavities formed therein;

an electronic communications circuit located in a first one of said cavities;

an antenna located in a second one of said cavities, said antenna including:

a metallic base plate which is disposed on a first printed circuit board and forms a ground plane, a folded radiating element formed on a second printed circuit board and having a first linear portion which extends in a direction generally perpendicular to said base plate and a second linear portion connected to said first portion and extending in a direction generally parallel to said base plate, and a shunt inductance connecting said first portion of said radiating element to said base plate; and a cable having plural conductors which respectively connect said base plate and said radiating element to said circuit.

11. The communications system of claim 10 wherein at least one wall of said second cavity is lined with a metallic material.

12. The communications system of claim 10 wherein at least one wall of said first cavity is lined with a metallic material.

13. The communications system of claim 10 further including a second antenna located in a third one of said cavities, said antennas being spaced from one another by a distance related to a frequency band over which communications are to take place.

14. The communications system of claim 10 wherein said second printed circuit board is perpendicularly mounted on said first printed circuit board.

15. The communications system of claim 14 wherein said second printed circuit board is mounted at or near the center of said first printed circuit board.

16. The communications system of claim 13, wherein said antennas are spaced at a distance equal to an odd number times one-fourth of the wavelength of a signal at a frequency over which communications are to take place.

17. The communications system of claim 10, wherein said housing is adapted to be connected to a portable computer.

18. An antenna assembly, comprising:

a first printed circuit board having a conductive coating on at least one side thereof and forming a ground plane;

a second printed circuit board perpendicularly mounted on said first printed circuit board at or near the center thereof, said second printed circuit board including:

an L-shaped metallic radiating element having a first leg oriented in a direction substantially perpendicular to said ground plane and a second leg substantially parallel to said ground plane; and a shunt inductance connecting said radiating element to said ground plane; and a cable having a first conductor connected to said first leg of said radiating element and a second conductor connected to said ground plane.

19. The antenna assembly of claim 18 wherein said first printed circuit board has a square shape.

20. The antenna assembly of claim 18 wherein said first leg of said radiating element is located along one edge of said second printed circuit board, and said second leg is located along an edge of said second printed circuit board that is remote from said first printed circuit board.

* * * * *